United States Patent [19]

Tone et al.

[11] 4,224,994

[45] Sep. 30, 1980

[54] SINGLE CONTROL FOR GAS ACTUATED FIRE EXTINGUISHERS

[75] Inventors: Melvin N. Tone; Larry J. Zimmer; James W. Jewett, all of Dubuque, Iowa

[73] Assignee: Deere & Company, Moline, Ill.

[21] Appl. No.: 50,788

[22] Filed: Jun. 21, 1979

[51] Int. Cl.[3] ..... A62C 35/18

[52] U.S. Cl. ..... 169/9; 169/88

[58] Field of Search ..... 169/9, 33, 62, 85, 88; 222/4, 5, 82, 83, 85, 135, 136

[56] References Cited

U.S. PATENT DOCUMENTS

| | | | |
|---|---|---|---|
| 191,872 | 6/1877 | Martin | 169/9 |
| 2,072,577 | 3/1937 | Allen | 222/5 X |
| 3,965,988 | 6/1976 | Wesson et al. | 109/9 |

*Primary Examiner*—Stanley H. Tollberg
*Assistant Examiner*—Fred A. Silverberg

[57] ABSTRACT

The discharge apparatus is used in conjunction with a fire suppression system and includes a plurality of gas cartridges communicating with one or more fire extinguishing tanks. The discharge apparatus includes a first cylinder-piston device which upon activation punctures a diaphragm of a gas cartridge. Gas released from the first gas cartridge pressurizes a related fire extinguishing tanks to cause extinguishing chemicals to be discharged. A small portion of the gas released from the first gas cartridge is responsible for the activation of a second cylinder-piston device associated with a second gas cartridge to cause the release of gas. The gas released from the second gas cartridge pressurizes a related fire extinguishing tank to cause extinguishing chemical to be discharged.

3 Claims, 1 Drawing Figure

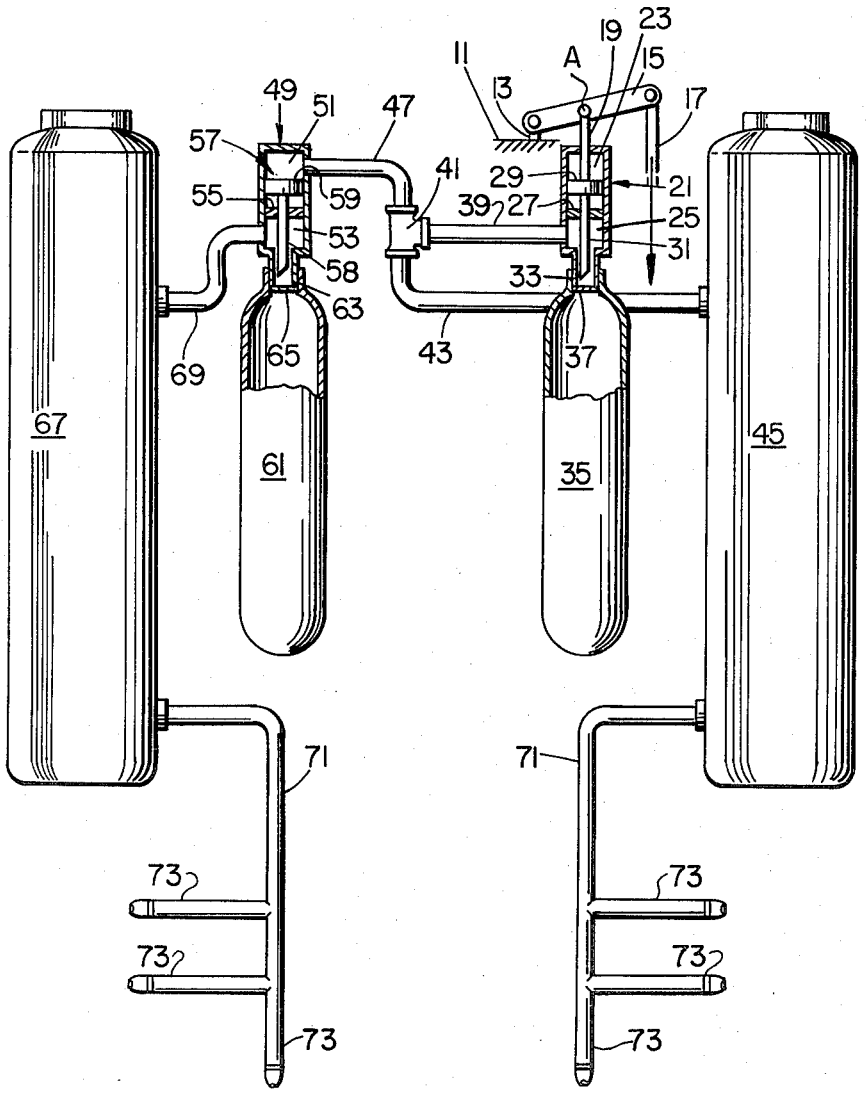
11
13
A
19
23
15
17
49
51
47
57
41
29
21
55
59
39
27
25
53
31
58
33
63
69
65
43
37
67
61
35
45
71
71
73
73
73
73
73
73

SINGLE CONTROL FOR GAS ACTUATED FIRE EXTINGUISHERS

BACKGROUND OF THE INVENTION

This invention relates to fire suppression systems which utilize a pressure influence gas to motivate the release of extinguishing chemicals from an extinguishing tank, more particularly to such a fire suppression system utilizing a plurality of extinguishing tanks.

Fire suppression systems have been utilized to protect aircraft, railway cars and recently, heavy machinery such as loggers and construction equipment. A conventional fire suppression system will contain one or more dry chemical or extinguishing tanks. It is customary to use a separate discharge mechanism for each extinguishing tank even though the tanks are discharged simultaneously. The use of separate discharge mechanism imports a substantial degree of multiplicity into the fire suppression system.

The present invention provides a single discharge mechanism for utilization in a fire suppression system.

SUMMARY OF THE INVENTION

The discharge mechanism or apparatus is particularly suited for deployment in a fire suppression system used on heavy mobile machines such as tractors, log skidders, street sweepers and the like. The discharge mechanism includes a plurality of gas cartridges, each cartridge having a puncturable diaphragm and a cylinder piston affixed thereto. Each cylinder-piston has a first and second chamber wherein the piston head of a contained piston is located in the first chamber with the piston rod extending from the piston head to the second cylinder chamber. Activation of the discharge mechanism requires that the piston of the housing cylinder-piston associated with the first gas cartridge is motivated such that the piston rod punctures the diaphragm of the first gas cartridge, whereafter the release of gas is conducted to an associated extinguishing tank to cause the release of extinguishing chemical therefrom. A portion of the gas from the first gas cartridge is delivered to a first cylinder chamber of the second cylinder-piston to cause the contained piston to puncture the diaphragm of the second gas cartridge. The gas released from the second gas cartridge is delivered to a second extinguishing tank to cause the release of extinguishing chemical therefrom. In this manner each dry chemical or extinguishing tank is discharged of its contents utilizing the single discharge mechanism of the present invention.

BRIEF DESCRIPTION OF THE DRAWING

The FIGURE is a partially sectioned elevated view of the discharge apparatus in accordance with the present invention.

DESCRIPTION OF THE PREFERRED EMBODIMENT

Referring to the FIGURE, a base 11 has a first support rod 13 fixably mounted thereto by any conventional means. Rotatably mounted to one end of support rod 13 is one end of a lever member 15. Rotatably mounted to the other end of lever member 15 is a rod 17. Rotatably mounted to a point A along rod 15 is a piston rod 19.

Piston rod 19 travels through a first cylinder-piston 21. Cylinder-piston 21 has a first chamber 23 and second chamber 25, chambers 23 and 25 being separated by a piston retaining wall 27. Mounted to piston rod 19 by any conventional means in the first chamber 23 is the piston head 29. A piston rod section 31 of piston rod 19 travels from the first chamber 23 through the retaining wall 27 and into the second chamber 25. The cylinder-piston 21 is fixably mounted by any conventional means within a channel 33 of a first gas cartridge 35 opposite a cartridge diaphragm 37. It is observed that motion of rod 17 in the direction indicated causes piston rod 19 to travel a sufficient distance to allow piston rod 31 to rupture diaphragm 37 thereby releasing the gas contained in gas cartridge 35 into the second chamber 25.

A first conduit 39 is fixably mounted by any conventional means to the cylinder-piston 21 communicating with the second chamber 25 of the cylinder-piston 21. The other end of first conduit 39 is fixably mounted by any conventional means such as welding to one opening of a T fitting 41. A second conduit 43 is fixably mounted by any conventional means such as welding to a second opening of the T fitting 41 and is fixably mounted at the other end to a first extinguishing tank 45 by any conventional means such as welding such that gas conducted by conduit 43 can enter extinguishing tank 45. A third conduit 47 is fixably mounted to the remaining opening of T fitting 41 by any conventional means such as welding. The other end of conduit 47 is fixably mounted to a second cylinder-piston 49 to communicate with a first chamber 51 of cylinder-piston 49.

The second cylinder-piston 49 has a first and second chamber 51 and 53, respectively, separated by a piston retaining wall 55 and a contained piston 57. The piston head 59 of piston 57 is located in the first chamber 51 having a piston rod 58 fixably mounted to piston head 59 by any conventional means and extending from the first chamber 51 through piston retaining wall 55 into the second chamber 53.

The second cylinder-piston 49 is fixably mounted by any conventional means to a second gas cartridge 61 within a channeled opening 63 just opposite a diaphragm 65. It is observed that a small portion of the gas released from gas cartridge 35 into cylinder chamber 25 is permitted to travel through conduit 39 and 47 to the second cylinder 49 intruding into the first chamber 51 vertically above the piston head 59 thereby forcing the piston 57 to travel a sufficient distance to cause piston rod 58 to rupture diaphragm 65 to release gas from the second gas cartridge 61 into the second chamber 53 of cylinder piston 49. The released gas is conducted to a second extinguishing tank 67 via a conduit 69 fixably mounted to cylinder piston 49 communicating chamber 53 with extinguishing tank 67.

Chemical tank 45 and 67 each have a conduit 71 fixably mounted to the lower portion of the tank 45 or 67. Conduit 71 therefrom communicates with a plurality of conduits 73 such that extinguishing chemical contained within extinguishing tanks 45 and 67 can be discharged and delivered to various fire-prone locations of a carrying vehicle (not shown) due to gas pressurization of the extinguishing tanks 45 and 67.

The aforedescribed discharge apparatus presents the preferred embodiment of the present invention and is not to be interpreted as defining the scope of the invention since a variety of specific embodiments of the present invention are realizable. The scope of the present invention is defined by the claims.

I claim:

1. An apparatus comprising:

(a) a plurality of gas cartridges, each of said gas cartridges containing a pressure influenced gas and a puncturable diaphragm to permit release of said gas;

(b) a plurality of extinguishing tanks;

(c) a plurality of cylinder-pistons, each of said cylinder-pistons slidably containing a piston having a piston head located in a first chamber of said cylinder-piston and a piston rod fixably mounted to said piston head and extending into a second chamber of said cylinder-piston, each of said cylinder-pistons being fixably mounted to an associated gas cartridge such that slidable movement of said piston can cause said piston rod to puncture said diaphragm of said associated gas cartridge;

(d) first means for actuating said piston of one of said cylinder-pistons to puncture said diaphragm of said associated gas cartridge;

(e) second means to conduct a portion of said released gas from said associated gas cartridge to at least one of said extinguishing tanks, said second means to also connect said cylinder-pistons such that a portion of the gas released by said one of said cylinder-pistons is conducted to another of said cylinder-pistons to be received in a manner to move the piston to rupture its diaphragm to cause its associated gas cartridge to release gas to another extinguishing tank.

2. Apparatus as claimed in claim 1, wherein said second means comprises:

(a) a plurality of first conduits, one end of each of said first conduits fixably mounted to and communicating with said second chamber of one of said cylinder-pistons;

(b) a plurality of second conduits, one end of each of said second conduits fixably mounted to and communicating with said first chamber of one of said cylinder-piston such that a pressure influenced gas conducted by said second conduit can enter said first chamber to cause said piston to slidably move to puncture said diaphragm of said affixed gas cartridge;

(c) a plurality of T-joints each having the other end of one of said first and second conduits fixably mounted into a T-joint opening;

(d) a plurality of third conduits, one end of each of said third conduits fixably mounted to the remaining opening of one of said T-joints, the other end of said third conduits being fixably mounted to at least one of said extinguishing tanks.

3. An apparatus, comprising:

(a) a plurality of gas cartridges, each of said gas cartridges containing a pressure influenced gas and a puncturable diaphragm to permit release of said gas;

(b) a plurality of extinguishing tanks;

(c) a plurality of cylinder-pistons, each of said cylinder-pistons slidably containing a piston having a piston head located in a first chamber of said cylinder-piston and a piston rod fixably mounted to said piston head and extending into a second chamber of said cylinder-piston, each of said cylinder-pistons being fixably mounted to an associated gas cartridge such that slidable movement of said piston can cause said piston rod to puncture said diaphragm of said associated gas cartridge;

(d) first means for actuating said piston of one of said cylinder-piston to puncture said diaphragm of said associated gas cartridge;

(e) second means for conducting said gas released from said gas cartridge associated with said one cylinder-piston to one extinguishing tank and to another of said cylinder-pistons, such that said gas can cause the piston of another gas cartridge to slidably move to cause the release of gas from said another gas cartridge;

(f) third means for conducting said gas released from said another gas cartridge to another extinguishing tank.

* * * * *